United States Patent [19]

Reits

[11] Patent Number: 5,063,389

[45] Date of Patent: Nov. 5, 1991

[54] ANTENNA SYSTEM WITH ADJUSTABLE BEAM WIDTH AND BEAM ORIENTATION

[75] Inventor: Bernard J. Reits, Hengelo, Netherlands

[73] Assignee: Hollandse Signaalapparaten B.V., Hengelo, Netherlands

[21] Appl. No.: 582,808

[22] Filed: Sep. 13, 1990

Related U.S. Application Data

[63] Continuation of Ser. No. 318,995, Mar. 3, 1989, abandoned.

[30] Foreign Application Priority Data

Mar. 8, 1988 [NL] Netherlands ..... 8800538

[51] Int. Cl.[5] ..... H01Q 3/00; H01Q 15/14; H01Q 15/20

[52] U.S. Cl. ..... 342/359; 343/912; 343/915

[58] Field of Search ..... 342/359; 343/915, 912

[56] References Cited

U.S. PATENT DOCUMENTS

| | | | |
|---|---|---|---|
| 3,254,342 | 5/1966 | Miller | 343/915 |
| 3,401,390 | 9/1968 | Braccini et al. | 343/915 |
| 3,882,503 | 5/1975 | Gamara | 343/915 |
| 3,978,484 | 8/1976 | Collier | 343/754 |
| 4,090,204 | 5/1978 | Farhat | 343/754 |
| 4,750,002 | 6/1988 | Kommineni | 343/915 |

OTHER PUBLICATIONS

"The Multiplate Antenna", A. C. Schell, IEEE Transactions on Antennas and Propagation, vol. AP-14, No. 5.

*Primary Examiner*—Gregory C. Issing
*Attorney, Agent, or Firm*—Robert J. Kraus

[57] ABSTRACT

The antenna system is provided with at least one active radiation source (1) and a reflective surface (2), which is located in at least one part of the radiation (3) generated by the active radiation source (1). The reflective surface (2) is provided with a number of independently adjustable plates (2.j) for generating at least one radiation beam. The antenna system may be provided with means (4) to independently adjust the plates (2.j) for the purpose of (dynamically) orientating the antenna beam.

21 Claims, 3 Drawing Sheets

ANTENNA SYSTEM WITH ADJUSTABLE BEAM WIDTH AND BEAM ORIENTATION

This is a continuation of application Ser. No. 318,995, filed Mar. 3, 1989, now abandoned.

BACKGROUND OF THE INVENTION

The invention relates to an antenna system provided with at least one active radiation source and a reflective surface which is located in at least one part of the radiation generated by the active radiation source.

The reflector in conventional antenna systems has a fixed contour to generate a beam with a certain width and orientation. This construction however has the disadvantage that the antenna system is limited in its application: beam width and beam orientation remain fixed. Such antenna systems are usually also very bulky. Moreover, such antenna systems are unsuitable for application in a so-called 3 D radar, in which also the elevation of a target is determined

SUMMARY OF THE INVENTION

The invention has for its object to provide an antenna system whose beam parameters are very rapidly adjustable while the antenna characteristics, such as side lobes and grating lobes, are particularly favourable. The speed at which the beam parameters of the antenna system can be varied is so high that the antenna system is suitable for use in a 3 D radar applied as a tracking radar for tracking targets. The antenna system is however also suitable for use as a rapidly scanning search radar.

According to the invention the antenna system is for that purpose provided with at least one active radiation source and a reflective surface which is located in at least a part of the radiation having a wavelength $\lambda$ generated by the active radiation source, where the reflective surface is provided with a number of individually adjustable plates for the generation of at least one beam, where the adjusting means are suitable for translating the plates with respect to each other, and where a plate's dimensions are in the order of the radiation wavelength $\lambda$.

As a result of the fact that the reflective surface is provided with individual plates, a multifunctional antenna system of a limited volume is created. According to the invention the plates can be arranged in such a way that a beam is obtained having the required orientation and width. Moreover, an individual plate can be shifted almost $\frac{1}{2}\lambda$ towards the direction of the impinging radiation (with wavelength $\lambda$) without changing the phase of the reflected radiation. The individual plates thus enable the construction of an antenna system of which the contour, created by the individual plates, forms a practically flat surface, of which the normal is parallel to the mean direction of impinging radiation originating from the active radiation source and where the distance between an individual plate and the flat surface does not exceed $\frac{1}{2}\lambda$.

Because a plate has dimensions in the order of the wavelength $\lambda$, the potential dynamic qualities of the antenna system will be very high. As a result, the plates are very light and can therefore be rearranged very quickly. Because the plates are so small, it is especially advantageous according to the invention to make the plates translatable with respect to each other. It is after all particularly attractive to provide one plate with only one linear actuator, in view of the dimensions of the plate. However, it is surprising and completely unexpected that, when a plate is small with respect to the wavelength, while a plate cannot be rotated (no tilt) but just translated, an antenna system is obtained whose beam parameters can be adjusted very accurately, without interference of side lobes and/or grating lobes. Up till now it was assumed that antenna systems provided with plates having dimensions in the order of the radiation wavelength cannot generate a good beam without interference from side lobes and grating lobes.

An antenna system, known from IEEE Transactions on Antennas and Propagation, vol. AP-14, no. 5, September 1966 (US), page 550–560, is provided with plates which can be translated as well as rotated (tilt is adjustable). The tilt is adjustable per plate because a plate has a cross section of several meters, i.e. hundreds of times more than the wavelength $\lambda$. Such an antenna system can therefore be compared to an antenna system whose cross-section is shown in FIG. 2. An antenna system according to the invention however is shown in FIG. 3, from which it is clear that here a completely different antenna is concerned from that of FIG. 2. Because of the size of the plates, such an antenna system requires some 10 seconds to adjust the beam, making it unsuitable for the purpose for which the antenna system is applied according to the invention. An antenna system according to the invention (FIG. 3) therefore has an adjustment time which is less than 5 ms.

According to the invention, the antenna system is provided with means to independently adjust the plates for the purpose of orientating the antenna beam. This allows the construction of a dynamic antenna system having the above-mentioned advantageous characteristics. By adjusting and readjusting the individual plates using the adjusting means, an antenna system is obtained having a dynamically orientatable beam and dynamically adjustable beam width. This is particularly important for application in a 3 D radar tracking a target by directing the beam and keeping it fixed on the target.

Another development known from radar technology is the so-called phased-array antenna which concerns an antenna comprising a number of active elements. Beamforming in a desired direction is achieved by controlling the position of a sufficient number of active elements having a proper mutual phase relationship. The disadvantage of such a system however is that it is very expensive due to the large number of active elements. The antenna system according to the invention requires only one active element, resulting in an enormous cost reduction, while the performance is able to meet the highest requirements.

It is known from U.S. Pat. No. 4,090,204 to use plates which are adjustable only across a fraction of the wavelength, applying an "electromagnetic lens". However, the disadvantage of this method is that side lobes are generated, while the accuracy with which a beam can be orientated is absolutely insufficient for use as e.g. a 3 D tracking radar.

If two adjacent surfaces have been translated with respect to each other across a relatively long distance, the first surface may cast a shadow on the second surface as regards the radiation generated by the active radiation source.

According to the invention, shadowing can also be prevented by applying strips of metal between adjacent plates, which strips are orientated practically parallel with the normal of the relevant plates and which extend beyond the plates in the direction of the impinging beam from at least one active radiation source. The plates are now positioned as it were inside a waveguide, where a plate serves to close off the waveguide. Shadowing therefore does not occur here. The dynamic properties of the antenna system according to the invention can even be increased if the antenna system is provided with a reservoir filled with a medium, where the plates are located inside the reservoir, and the walls of the reservoir are suitable for letting through electromagnetic waves. As a result of the presence of the medium, having an electric permeability $\epsilon$, the wavelength $\lambda$ will be reduced in the medium by a factor $\sqrt{\epsilon}$. The advantage of this is that the maximum required translation distance of an individual plate is reduced by a factor $\sqrt{\epsilon}$. This, however, results in a considerable increase of the mobility of the generated beam.

According to the invention it is also possible to generate more than one orientatable beam. For this purpose, the plates can be adjusted in such a way that p antenna subsystems (p=1,2, 3, . . . ) are created to generate p orientated beams, where the plates belonging to an antenna subsystem comprise at least one group of plates.

According to a special embodiment of the invention the plates are circular and arranged in a compact stack. Since the gaps between the different sections is minimized, the section, if the plates are sufficiently small, will behave like a so-called Faraday shield, resulting in an apparently closed reflective surface for the impinging radiation.

The invention will now be described in more detail with reference to the accompanying figures of which:

DETAILED DESCRIPTION OF THE INVENTION

Figure 1:
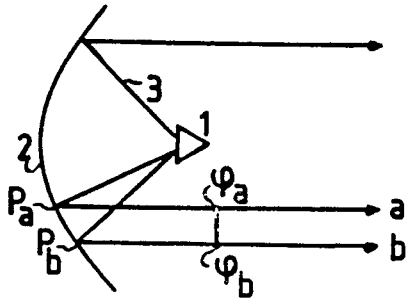
FIG. 1 represents a cross-section of a conventional antenna system.

FIG. 1 shows a feedhorn 1 in a cross-section of a simple conventional antenna system. Feedhorn 1 is positioned opposite a reflective surface 2 and generates electromagnetic waves having a wavelength $\lambda$ in the direction of surface 2. In case of radar applications, a receiving horn may also be used for the reception of echo signals reflected by an object. The contour of the reflective surface is such that after reflection against surface 2 a practically parallel or somewhat diverging beam 3 is obtained. For this purpose, the surface may for instance have an almost parabolic contour, where the feedhorn is situated in the focal area, preferably the focal point of the contour. After reflection, the phase difference $\Delta\phi=\phi_a-\phi_b$ between outgoing beams a and b in the indicated direction appears to be $\Delta\phi=0°$, as a result of which these beams amplify each other in this direction. It will be clear that a similar beam is obtained when the phase difference $\Delta\phi=\phi_a-\phi_b=\pm k\times 360°$ (k=1, 2, . . . ).

Figure 2:
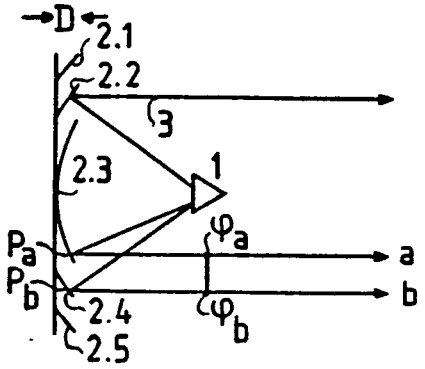
FIG. 2 represents a cross-section of an antenna system as an illustration of the principle of the invention.

This implies that reflection points $\phi_a$ and $\phi_b$ can be shifted with respect to each other across a distance of $\pm k\times\frac{1}{2}\lambda$ (k=1, 2, . . . ) in the direction of the impinging beam without changing the reflective properties of the reflective surface. In FIG. 2 the reflector is provided with five individual plates 2.i (i=1, 2, . . . , 5). Plates 2.2 and 2.4 have been shifted in the direction of the impinging beam across a distance $\frac{1}{2}\lambda$ with respect to surface 2, while plates 2.1 and 2.5 have been shifted in the direction of the impinging beam across a distance $\lambda$ (see FIG. 2). The phase relationship between the outgoing beams after reflection has thus been maintained. A plate 2i (i=1, . . . , 5) in this example shows along its surface a phase shift of $\alpha\phi<180°$ with respect to the incoming beam. Thus the volume of reflective surface 2 has been considerably reduced: the "thickness" D of the reflective surface (see FIG. 2) equals at the most $\frac{1}{2}\lambda$, so the reflective surface is practically flat. The reflective surface of FIG. 2 is however not suitable for a dynamic construction when high speeds are required. This is caused by the plates being relatively large and, consequently, slow.

Figure 3:
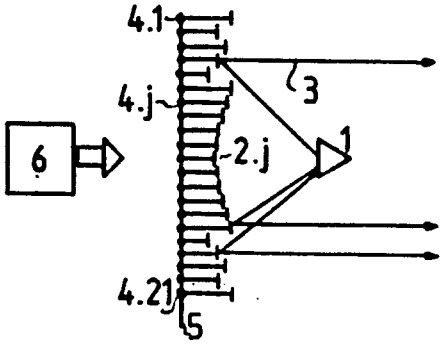
FIG. 3 represents a cross-section of a dynamic embodiment of an antenna system according to the invention.

In FIG. 3 the reflective surface of FIG. 2 has been replaced by a reflective surface according to a dynamic embodiment of the invention. Reflective surface 2 has for this purpose been provided with a large number of plates 2.j (j=1, 2, . . . , 21). Plates 2.j have been provided with adjusting means 4.j (j=1, 2, . . . , 21), mounted on a support 5 with which a plate 2.j can be moved up and down. The direction of movement in this example is perpendicular to support 5.

In FIG. 3, plates 2.j have been arranged in such a way that they follow the contour of FIG. 2 and thus generate a beam according to the antenna system of FIG. 1. The plates 2.j (j=6–16) form a group of which the phase difference $\Delta\phi$ between plates is $\Delta\phi<180°$. Other groups are formed by plates 2.j (j=1,2), plates 2.j (j=3–5), plates 2.j (j=17–19) and plates 2.j (j=20,21). The plates at the edges of two adjacent groups (e.g. plates 2.16 and 2.17) however, are plates of which the phase difference $\Delta\phi\approx 180°$. This has the advantage that adjusting means 4.j only require an adjustment range of not more than $\frac{1}{2}\lambda$, which equals a maximum phase difference of $\Delta\phi=180°$. It is of course also possible to arrange the plates in such a way that within a group of plates, a phase difference $\Delta\phi$ occurs of approximately n.180° (n=2, 3, . . . ), while the phase difference between two adjacent plates belonging to different groups amounts to approximately n.180°. The difference in distance between two adjacent plates belonging to different groups then amounts of n.$\frac{1}{2}\lambda$, while the difference in distance between adjacent plates within a group of plates, when the number of plates is sufficiently high, is lower than n.$\frac{1}{2}\lambda$. The plates of FIG. 3 have a cross section less than $\lambda$ to make them sufficiently light. As a result, the plates can be rapidly translated with respect to each other, increasing the dynamic qualities of the antenna. The size of a plate is in the order of 5 mm.

The groups of plates are preferably formed in such a way that n=1. This is particularly advantageous when by means of control means 6, controlling the adjusting means, the reflective surface 2.j is constantly adapted to orientate and reorientate the reflected beam. Moreover, the divergency of the beam may be changed by rearranging the plates with respect to each other. Since n=1 the maximum distance to be covered by the adjusting means in positioning the plates with respect to each other is only $\frac{1}{2}\lambda$. In this way, the amount of time required to direct a beam is minimized and the dynamic qualities are maximized. An antenna system according to the invention is capable of orientating a beam in the required direction within 10 ms.

Figure 4:
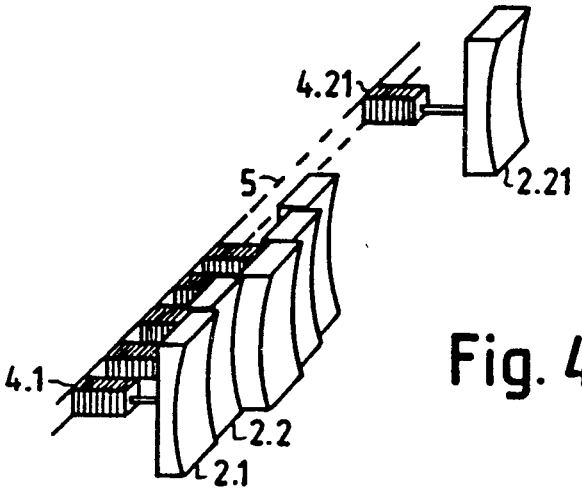
FIG. 4 represents a second embodiment of an antenna system according to the invention.

If the direction of the antenna beam generated by means of the antenna system of FIG. 3 is gradually changed, this is realised by moving the plates with respect to each other in such a way that the contour they form, as indicated in FIG. 3, propagates visually like a travelling wave parallel with the surface of support 5. This causes a relative movement of the feedhorn in the focal area formed by plates 2.j, resulting in a beam which changes direction. If the plates are arranged in a straight line, the beam can be controlled in one direction only, e.g. in azimuth in case the antenna system is used as a search radar to perform a sweep across an azimuth width of for instance 90°. The beam width and elevation can then be fixed by giving plates 2.j a certain dimension vertically and, if necessary, applying for instance a parabolic contour. FIG. 4 shows such an antenna system, using the same reference numerals as FIG. 3.

By means of four similar perpendicularly positioned antenna systems, a sweep can be made across 360°. Due to the fact that they are flat, the four antenna systems can be used for naval applications, mounted to the walls of a ship.

Application in 3 D radars requires an antenna beam that can be orientated in azimuth and in elevation. A possible embodiment of such a reflective surface is shown in FIG. 5.

Figure 5:
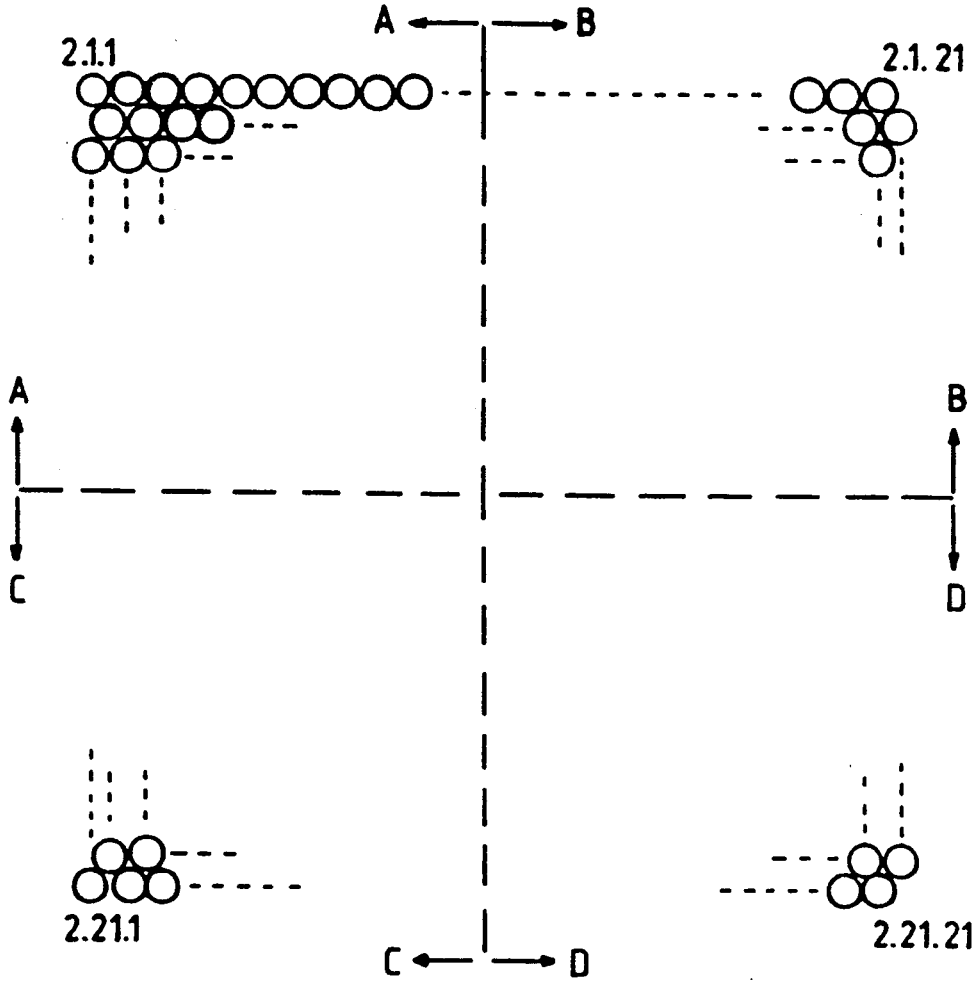
FIG. 5 represents a third embodiment of an antenna system according to the invention.

In FIG. 5, the plates 2.m.n are arranged according to a matrix structure (j=m,n=1, 2, . . . , 21). The plate in this figure are circular and arranged with respect to each other by means of a most compact stacking. As a result, the gaps between plates are minimized, thus homogenizing the reflective surface. The dimension of a gap can be such that it behaves like a Faraday shield, as a result of which this gap appears not to exist for impinging radiation. A plate can also be according to other embodiments, such as a regular n-angle ($n \geqq 3$). By arranging plates 2.m.n, horizontally as well as vertically in accordance with a certain antenna contour, a beam may be directed in azimuth as well as in elevation.

FIG. 3 shows a side view of a horizontal or vertical row of plates of FIG. 5.

Figure 6:
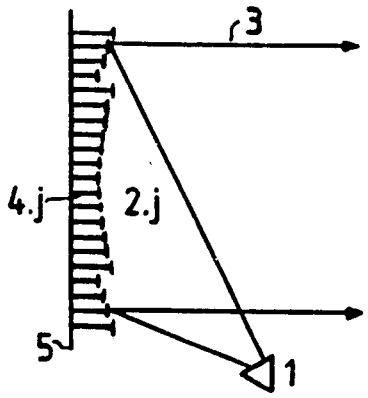
FIG. 6 represents a cross-section of a fourth embodiment of an antenna system according to the invention.

The feedhorn in FIG. 3 does not particularly need to be situated in the corresponding focal point in case the plates form an effective reflector with a parabolic contour. An orientatable beam is also generated if the feedhorn is located somewhere else in the focal area. It is also not especially necessary that the focal area be parallel to support 5. This opens the possibility to place the feedhorn next to the beam going out after reflection. FIG. 6 shows a simplified cross section of such a system with the accompanying radiation path.

A more cost-effective embodiment of the antenna system according to the invention is obtained if a number of plates is not present, e.g. the even-numbered plates 2.m.n and 2.j respectively. It has been proven that the performance of such an antenna system deteriorates only very slightly.

Figure 7:
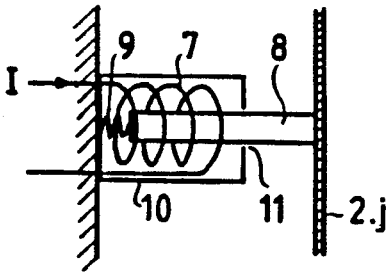
FIG. 7 represents a first embodiment of a means for adjusting a plate.

FIG. 7 shows a possible embodiment of an adjusting means (4.j or 4.m.n) for a plate (2.j or 2.m.n). The adjusting means is provided with a coil 7 and a magnetic core 8 incorporated in the coil. Magnetic core 8 is connected to a housing 10 by means of a spring 9. A plate 2.j is connected on the outside to an extension of magnetic core 8, which is partly positioned outside housing 10 through feedthrough aperture 11. With the supply of control signals generated by control means 6, the magnetic core can be moved towards a state of equilibrium in which the resilience of the spring and the Lorentz force of magnetic core 8 and coil 7 compensate each other.

Figure 8:
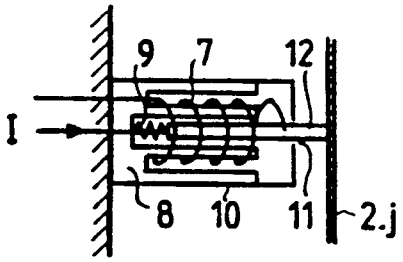
FIG. 8 represents a second embodiment of a means for adjusting a plate.

Another embodiment of an adjusting means (4.j or 4.m.n) for a plate (2.j or 2.m.n) is shown in FIG. 8. The adjusting means is provided with a coil 7 and a magnet 8 incorporated in and around the coil. Magnet 8 has a fixed connection with housing 10. Spindle 12 is movable inside the magnet. The spindle is connected to housing 10 via a spring 9. One end of coil 7 is connected to spindle 12. With the supply of control signals generated by control means 6, the magnet can be moved towards a state of equilibrium in which the resilience of the spring and the Lorentz force of magnet 8 and coil 7 compensate each other. To decrease the friction between spindle 12 and magnet 8, a high-frequency signal can be supplied additionally to the coil.

Figure 9:
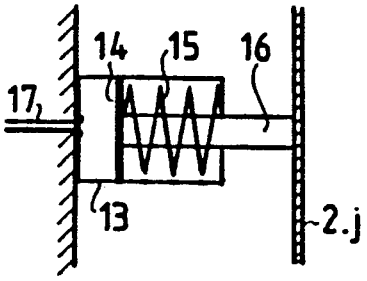
FIG. 9 represents a third embodiment of a means for adjusting a plate.

An alternative embodiment of an adjusting means is shown in FIG. 9. In this embodiment a cylinder 13 is provided with a piston 14, which can be brought in an extreme position by means of a spring 15. Piston 14 is connected to plate 2.j via a bar 16. By supplying air via duct 17, which for this reason is connected to control means 6, the cylinder and thus plate 2.j is brought into the required position.

Figure 10:
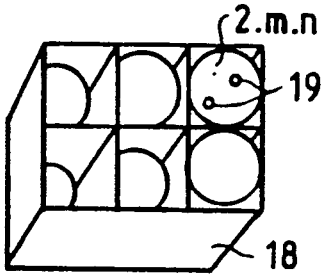
FIG. 10 represents a fifth embodiment of a part of an antenna system according to the invention.

The phase jump of approximately $n \times \frac{1}{2}\lambda$ (n=1, 2, . . . ) between adjacent plates of different groups may create the adverse effect of shadowing. To solve this problem, according to the invention reflective surface 2 can be provided with strips of metal placed between the plates and forming a screen work 18. FIG. 10 shows a part of such an antenna system. The plates, in any possible position, are flush with the screen, so the plates are located as it were inside a waveguide. Due to the waveguide effect of screen 18, shadowing is prevented: the impinging radiation moves via the walls of screen 18 to a plate 2.m.n and vice versa after reflection on the plate.

As mentioned before, the range of the adjusting means must be at least $\frac{1}{2}\lambda$. When the frequency of the radiation generated by feedhorn 1 is decreased, the adjustment range will have to increase. As a result, the average time within which a plate can be brought to the required position increases. According to a special embodiment of the invention, to achieve this, the antenna system is provided with a reservoir within which the reflection surface is placed. The reservoir is filled with a medium having a high electrical permeability $\epsilon$. As a result, the wavelength of the impinging and reflected radiation within the medium will decrease by a factor $\sqrt{\epsilon}$, while the frequency remains the same. Because the wavelength has decreased by a factor $\sqrt{\epsilon}$ ($\lambda' = \lambda/\sqrt{\epsilon}$), the range of the adjustment means will also decrease by a factor $\sqrt{\epsilon}$. The advantage of this is that the average time required to position a plate decreases.

As a result, the antenna system becomes more dynamic. Depending on the viscosity of the medium however, the dynamics of the antenna system can decrease as a result of friction between the medium and a moving plate. For this purpose, a plate (2.jor 2.m.n) may also be provided with at least one feedthrough aperture 19 (see FIG. 10), where, when a plate moves, the medium can flow through the throughput aperture freely, so that the average friction will decrease. This throughput aperture is preferably smaller than λ to prevent the reflective properties of a plate being changed by the presence of the throughput aperture.

In accordance with the antenna system according to the invention, it is also possible to generate more than one beam. In that case the antenna system comprises p (p=2, 3, . . . ) antenna subsystems. For this purpose the reflective surface of FIG. 5 can for instance be divided into p=4 sectors A, B, C and D, where the plates of a sector are positioned in such a way that they generate a beam independently of the plates of the sectors.

I claim:

1. An antenna system comprising:

an active radiation source having a wavelength λ;

a substantially flat, contoured surface formed by a plurality of separate and independently adjustable adjacent reflecting plates having transverse dimensions on the order of the wavelength λ positioned for reflecting the radiation and forming at least one radiation beam; and adjusting means for dynamically translating the plates with respect to each other during operation of the antenna system, thereby determining the antenna beam pattern;

wherein, for orienting at least one beam, the plates are arranged in groups of plates for which the mutual difference in radiation path distance from the active radiation source to two adjacent plates respectively belonging to the same group is much less than $n \times \frac{1}{2}\lambda$ (n=1, 2, . . . ) and where the mutual difference in radiation path distance from the active radiation source to the two adjacent plates respectively belonging to different groups is substantially $n \times \frac{1}{2}\lambda$.

2. An antenna system as claimed in claim 1, where the transverse dimensions of a plate are less than λ.

3. An antenna system as claimed in claim 1 or 2, characterized in that the antenna system is provided with means to independently adjust the plates for the purpose of orienting the antenna beam.

4. An antenna system as claimed in claim 1 or 2, characterized in that the adjusting means is effective for adjustment of the divergence of at least one beam.

5. An antenna system as claimed in claim 1 or 2, characterized in that the plates are arranged in one plane.

6. An antenna system as claimed in claim 1, characterized in that n=1.

7. An antenna system as claimed in claim 1, characterized in that the centers of the plates belonging to a group are arranged substantially in a parabolic contour, and at least one active radiation source is situated substantially in the central area of the parabolic shape.

8. An antenna as claimed in claim 7, characterized in that the plates near the edge of the antenna are orienting with respect to each other in such a way that tapering is achieved.

9. An antenna system as claimed in claim 1, characterized in that the normals of the plates have substantially the same direction.

10. An antenna system as claimed in claim 1 or 2, characterized in that the antenna system is provided with control means for controlling the adjusting means and where the control means are operable for the gradual arranging and rearranging of the plates with respect to each other, thus achieving a dynamic reflector surface for the gradual orienting of at least one beam and for the gradual variation of the beam width.

11. An antenna system as claimed in claim 3, characterized in that the adjusting means are provided with a number of linear actuators where a linear actuator is comprised of a first part and a second part which can be moved with respect to the first part, and where a plate is fixed to a first part of a linear actuator and where the two parts of the linear actuators are substantially rigidly connected to each other.

12. An antenna system as claimed in claim 10, characterized in that the linear actuator is provided with a coil and a magnet which is moveable inside the coil, to which magnet the plate is fixed and where the coil is controlled with electrical signals generated by the control means.

13. An antenna system as claimed in claim 10, characterized in that the linear actuator is provided with a moveable coil and a magnet applied in and around the coil and where the plate is fixed to the coil which is controlled with electrical signals generated by the control means.

14. An antenna system as claimed in claim 12, characterized in that the control system is provided with means to modulate the linear actuator.

15. An antenna system as claimed in claim 10, characterized in that the linear actuator is provided with a reciprocating system comprised of a cylinder and piston where a plate is fixed to the piston and where the reciprocating system is controlled by means of pneumatic signals generated by the control means.

16. An antenna system as claimed in claim 15, characterized in that the reciprocating system is of the gas filled type.

17. An antenna system as claimed in claim 1 or 2, characterized in that the antenna system is provided with a reservoir filled with a medium, where the plates are located inside the reservoir and the walls of the reservoir are suitable for letting through electromagnetic waves.

18. An antenna system as claimed in claim 1 or 2, characterized in that the plates are circular.

19. An antenna system as claimed in claim 17, characterized in that the plates are arranged in a compact array.

20. An antenna system as claimed in claim 1 or 2, characterized in that a number of plates comprise at least one through hole.

21. An antenna system as claimed in claim 1 or 2, characterized in that the plates are arranged in a line.

* * * * *